US005678425A

United States Patent [19]

Agrawal et al.

[11] Patent Number: 5,678,425

[45] Date of Patent: Oct. 21, 1997

[54] METHOD AND APPARATUS FOR PRODUCING LIQUID PRODUCTS FROM AIR IN VARIOUS PROPORTIONS

[75] Inventors: Rakesh Agrawal, Emmaus; Zbigniew Tadeusz Fidkowski, Macungie; Shyam Ramchand Suchdeo, Wescosville, all of Pa.

[73] Assignee: Air Products and Chemicals, Inc., Allentown, Pa.

[21] Appl. No.: 660,311

[22] Filed: Jun. 7, 1996

[51] Int. Cl.[6] ..... F25J 3/04

[52] U.S. Cl. ..... 62/646; 62/939; 62/940

[58] Field of Search ..... 62/645, 646, 939, 62/940

[56] References Cited

U.S. PATENT DOCUMENTS

| | | | |
|---|---|---|---|
| 3,605,422 | 9/1971 | Pryor et al. . | |
| 4,152,130 | 5/1979 | Theobald . | |
| 4,375,367 | 3/1983 | Prentice . | |
| 4,543,115 | 9/1985 | Agrawal et al. | 62/646 |
| 4,715,873 | 12/1987 | Auvil et al. . | |
| 4,717,410 | 1/1988 | Grenier | 62/913 X |
| 4,853,015 | 8/1989 | Yoshino | 62/913 X |
| 4,894,076 | 1/1990 | Dobracki et al. . | |
| 4,957,524 | 9/1990 | Pahade et al. | 62/908 X |
| 5,006,137 | 4/1991 | Agrawal et al. | 62/646 |
| 5,006,139 | 4/1991 | Agrawal et al. | 62/646 |
| 5,257,504 | 11/1993 | Agrawal et al. | 62/646 |
| 5,355,680 | 10/1994 | Darredeau et al. | 62/913 X |
| 5,355,681 | 10/1994 | Xu . | |
| 5,440,885 | 8/1995 | Arriulou | 62/646 |

FOREIGN PATENT DOCUMENTS 1 472 402 5/1977 United Kingdom .

*Primary Examiner*—Christopher Kilner
*Attorney, Agent, or Firm*—Willard Jones, II

[57] ABSTRACT

A cryogenic method and apparatus using a liquefier and a two stage distillation column capable of operating in two modes, namely a first mode of operation during which only liquid nitrogen is produced and a second mode of operation during which liquid nitrogen and liquid oxygen are produced. By adjusting the time of operation in each mode, any ratio of liquid nitrogen to liquid oxygen greater than the ratio achieved during the second mode of operation can be achieved. In the first mode of operation, a condenser is used to condense the lower pressure stage gaseous nitrogen into lower pressure stage nitrogen condensate. To condense the lower pressure stage gaseous nitrogen, either at least a portion of the crude oxygen liquid from the higher pressure stage, at least a portion of the oxygen-enriched liquid from the lower pressure stage, at least a portion of the liquefied air, or mixtures thereof, are introduced to the condenser. In the second mode of operation, the top condenser is not used; instead, all of the crude oxygen liquid is introduced into the lower pressure stage, which produces a bottom liquid oxygen stream and a low pressure overhead waste stream containing nitrogen. The system includes fluid flow lines and valves for directing the flow of certain fluids, particularly the crude oxygen liquid and the oxygen-enriched liquid, during the two modes of operation.

21 Claims, 7 Drawing Sheets

METHOD AND APPARATUS FOR PRODUCING LIQUID PRODUCTS FROM AIR IN VARIOUS PROPORTIONS

FIELD OF THE INVENTION

The present invention pertains to the production of liquid nitrogen as a single product, or liquid nitrogen and liquid oxygen as two products, in a cryogenic air separation system.

BACKGROUND OF THE INVENTION

Liquefied atmospheric gases, e.g. oxygen, nitrogen, argon, etc., are increasingly used in industry, providing cryogenic capabilities for a variety of industrial processes. As liquids, atmospheric gases are more economical to transport and store in large quantities and provide ready and economical sources for gaseous products from liquid storage facilities.

The production of liquefied atmospheric gases, particularly liquid nitrogen, requires more energy than the production of corresponding gaseous products because additional energy is required for liquefaction. Therefore, to meet the increasing needs for liquid atmospheric gases, it is desirable to develop a process which is energy efficient in operation and economical from a capital standpoint. Many various systems have been used previously in an attempt to meet these needs.

For example, U.S. Pat. No. 3,605,422 discloses an air separation and liquefaction process, in which liquid nitrogen and liquid oxygen are produced directly from a two stage distillation column. A nitrogen recycle refrigeration system is used to provide sufficient refrigeration to produce liquids. Nonetheless, this process is capital intensive.

British Patent No. 1,472,402 discloses a cryogenic air separation cycle in which gaseous nitrogen is withdrawn from a distillation column, is liquefied in a separate system, and is subsequently partially recovered as a product and partially recycled to the distillation column as reflux.

U.S. Pat. No. 4,152,130 discloses a process for producing liquid nitrogen and liquid oxygen by the cryogenic separation of air using a two stage distillation column and an air recycle liquefaction system. Gaseous and liquid air are delivered to the high pressure stage of the distillation column as feeds. Liquid nitrogen is withdrawn from the reboiler/condenser of the high pressure stage of the distillation column, and liquid oxygen is derived from the sump of the low pressure stage of the column. A liquid fraction is also withdrawn from the high pressure stage of the column and is ultimately used as reflux for the low pressure stage of the column. The removal of liquid nitrogen as a product directly from the high pressure stage of the distillation column reduces the amount of available reflux in the low pressure stage of the column, which limits liquid product recoveries. U.S. Pat. No. 4,375,367 discloses a process derived from the '130 patent which requires less capital expenditure due to the elimination of a tandem compander apparatus.

U.S. Pat. No. 4,715,873 discloses a cycle wherein at least a portion of the liquid feed air bypasses the distillation column and is used to liquefy the gaseous products of the column. The resulting vapor air stream is retained at elevated pressure.

U.S. Pat. No. 5,355,681 discloses a process for the separation of air into its components using a distillation column system having at least two distillation columns. A portion of the feed air is condensed and at least a portion of this liquefied air is used as impure reflux in one of the distillation columns. A waste stream is removed from a location situated no more than four theoretical stages above the location where the liquefied air is fed to one of the columns.

In these and other known prior art processes, liquid nitrogen and liquid oxygen with high recovery can typically provide only certain relative amounts of the two products. These relative amounts are not always consistent with current demand. Therefore, there is a need for greater flexibility in the relative amounts of liquid nitrogen and liquid oxygen produced, without sacrificing any power.

More specifically, demand for liquid oxygen and liquid nitrogen changes (sometimes unpredictably) over time. A liquefier with a full recovery of nitrogen and oxygen from air cannot usually satisfy market needs over the life of a given plant, because total plant production is limited by the size of the plant and because the ratio of liquid nitrogen produced to liquid oxygen produced is, in part, determined by air composition. Therefore, an existing full recovery liquefier is only able to match a demand for one of its products (either nitrogen or oxygen) producing at the same time too little or too much of the other product. Moreover, a plant cannot continue to produce too much of one of its cryogenic liquids without being able to sell it, because of the high power cost and limited storage capacity. This leads to the need to reduce the total production of the plant (i.e., "turn down"), which is highly uneconomical and undesirable.

SUMMARY OF THE INVENTION

The present invention is directed to a method for operating a cryogenic distillation column having a higher pressure stage and a lower pressure stage to produce liquid nitrogen alone or liquid nitrogen and liquid oxygen. The present invention is also directed to a system capable of operating in two modes, namely a first mode of operation during which only liquid nitrogen is produced and a second mode of operation during which liquid nitrogen and liquid oxygen are produced.

According to a first embodiment of the present invention, a cryogenic distillation column having a higher pressure stage and a lower pressure stage is operated to produce only liquid nitrogen. A liquefier provides a stream of cooled gaseous feed air and a stream of liquefied air. The cooled gaseous feed air is introduced into the higher pressure stage for rectification into a high pressure nitrogen overhead at the top of the higher pressure stage and a crude oxygen liquid at the bottom of the higher pressure stage. The high pressure nitrogen is condensed by heat exchange with an oxygen-enriched liquid from the bottom of the lower pressure stage. A portion of the condensed nitrogen is used as reflux to the higher pressure stage and the remaining portion of the condensed nitrogen is withdrawn as liquid nitrogen product. The liquefied air may be cooled, and at least a portion of the liquefied air is introduced to the lower pressure stage to be separated into lower pressure stage gaseous nitrogen at the top of the lower pressure stage and an oxygen-enriched liquid at the bottom of the lower pressure stage. At least a portion of the crude oxygen liquid, at least a portion of the oxygen-enriched liquid, at least a portion of the cooled liquefied air, or mixtures of any of these three liquids may be introduced into a condenser of the lower pressure stage to condense the lower pressure stage gaseous nitrogen to form lower pressure stage nitrogen condensate. In a preferred embodiment, a stream including: (i) at least a portion of the crude oxygen liquid and (ii) at least a portion of at least one of the oxygen-enriched liquid and the liquefied air, is introduced to the condenser of the lower pressure stage, as opposed to any of these three streams or mixtures thereof. A portion of the lower pressure stage nitrogen condensate is utilized as reflux for the lower pressure stage, while the remaining portion of the lower pressure stage nitrogen condensate is withdrawn as liquid nitrogen product.

According to another embodiment of the present invention, the cryogenic distillation column is used to produce liquid nitrogen and liquid oxygen. Optionally, argon can also be produced in this embodiment. Both products are produced by varying the mode of production of the cryogenic process between a first mode of production during which only liquid nitrogen is produced and a second mode of operation during which liquid nitrogen and liquid oxygen are produced. The process during the first mode of operation is identical to the method described above. The second mode of operation is similar to the first mode of operation in that the liquefier is used to produce a stream of cooled gaseous feed air and a stream of liquefied air. Also similar to the first mode of operation, the cooled gaseous feed air is fed into the higher pressure stage for rectification into a high pressure nitrogen overhead and a crude oxygen liquid, and the high pressure nitrogen is condensed with some of it used as reflux to the higher pressure stage. In the second mode of operation, however, the condenser of the lower pressure stage is not used; instead, the crude oxygen liquid is cooled and introduced into the lower pressure stage. The liquefied air is also cooled and introduced to the lower pressure stage at a location different from where the crude oxygen liquid is introduced. The lower pressure stage produces a lower pressure overhead waste stream containing nitrogen (as well as oxygen and argon) and the oxygen-enriched liquid, which is a product liquid oxygen stream in this mode of operation. The product oxygen liquid is cooled against the crude liquid oxygen stream before the crude oxygen liquid is introduced to the lower pressure stage.

The present invention also includes a system, capable of operating in the two modes of operation, for producing liquid nitrogen and liquid oxygen, and optionally argon. The system includes the liquefier and the two stage distillation column having a reboiler/condenser for condensing the high pressure nitrogen from the higher pressure stage by heat exchange with the oxygen-enriched liquid from the bottom of the lower pressure stage. As in the processes described above, a lower pressure stage separates at least a portion of the cooled liquefied air into lower pressure stage gaseous nitrogen and an oxygen-enriched liquid. A top condenser condenses the lower pressure stage gaseous nitrogen selectively, namely only during the first mode of operation. In one embodiment, the system includes a first set of fluid flow lines and valves extending between the bottom of the higher pressure stage, the condenser, and the lower pressure stage, for permitting crude oxygen liquid to flow from the bottom of the higher pressure stage to: (i) the condenser during the first mode of operation, and (ii) the lower pressure stage during the second mode of operation. The system also includes a second set of fluid flow lines and valves extending between the bottom of the lower pressure stage, a liquid oxygen product storage, and the condenser, for permitting the oxygen-enriched liquid to flow from the bottom of the lower pressure stage to: (i) the condenser during the first mode of operation, and (ii) the liquid oxygen product storage during the second mode of operation. A third set of fluid flow lines and valves may be employed as an alternative to the second set of fluid flow lines and valves. The third set of fluid flow lines and valves extends between two positions near the bottom of the lower pressure stage, the liquid oxygen product storage, and a waste stream, for permitting: (i) a bottom vapor waste stream to flow from a first position near the bottom of the lower pressure stage to the vapor waste stream during the first mode of operation and (ii) the oxygen-enriched liquid to flow from a second position, below said first position, near the bottom of said lower pressure stage to the liquid oxygen product storage during the second mode of operation.

It is to be understood that both the foregoing general description and the following detailed description are exemplary, but are not restrictive, of the invention.

BRIEF DESCRIPTION OF THE DRAWINGS

The invention is best understood from the following detailed description when read in connection with the accompanying drawings, in which.

DETAILED DESCRIPTION OF THE INVENTION

The present invention pertains to an air liquefaction and air separation cycle capable of operation in at least two modes:

1) a first mode of operation, during which only liquid nitrogen is produced; and
2) a second mode of operation, during which liquid nitrogen and liquid oxygen are produced simultaneously.

The second mode of operation can be designed at any ratio of liquid nitrogen produced to liquid oxygen produced (hereinafter referred to a "LIN/LOX ratio"). A smaller LIN/LOX ratio in the second mode of operation provides for a wider range of overall production ratios. (An overall production ratio is defined as the time-averaged LIN/LOX ratio produced over a designated period of time.) Therefore, liquid oxygen production should be maximized in the second mode of operation. The cycle proposed in the present invention can efficiently produce liquid nitrogen and liquid oxygen at LIN/LOX ratio of 1:1 in the second mode of operation. Accordingly, in such a system, an overall production ratio can be anything greater than or equal to 1:1.

A desired overall production LIN/LOX ratio is achieved by running the plant in the two operating modes for different time intervals. If $t_1$ is the number of days of operation in the first mode of operation and $t_2$ is the number of days in the second mode of operation, then these time intervals should obey the following relation:

$$\frac{t_1}{t_2} = \frac{\alpha - \beta}{1 + \beta}$$

where:

$$\alpha = \left(\frac{LIN}{LOX}\right)_{Average}$$

$$\beta = \left(\frac{LIN}{LOX}\right)_{2ndMode}$$

While the relative values of $t_1$ and $t_2$ are given in the above equation, the absolute values will be dictated by the size of the liquid nitrogen and liquid oxygen storage tanks. The switch from one mode to the other should be performed such that the liquid levels in either of the tanks never exceed the acceptable limits.

Figure 1:
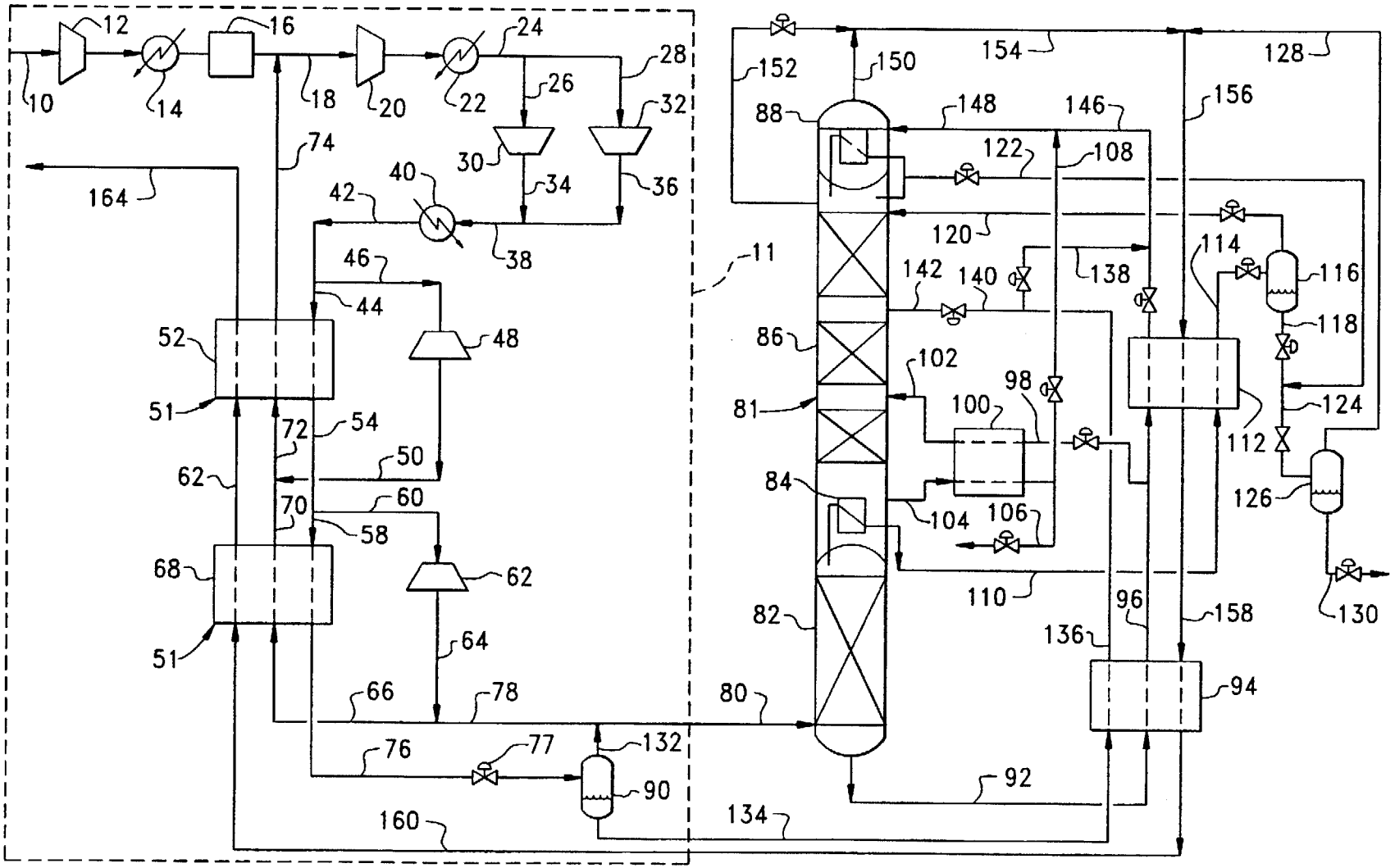
FIG. 1 is a schematic diagram of an embodiment of the present invention.

Referring now to the drawing, wherein like reference numerals refer to like elements throughout, FIG. 1 shows a preferred embodiment of the present invention using an air liquefier 11 and a two-stage cryogenic distillation column. Any type of known liquefier can be used, such as an air liquefier, a nitrogen liquefier, or a hybrid thereof (i.e., a combination of an air liquefier and a nitrogen liquefier). In addition, any known air liquefier can be used with various combinations of two or three expanders at high or low pressure, for example a three expander, high pressure liquefier as disclosed in U.S. Pat. No. 4,894,076.

For purposes of simplicity in discussing the present invention, a standard two-compander air liquefier 11 is shown. Feed air is introduced in feed air line 10, compressed in main air compressor 12, after cooled in heat exchanger 14, cleaned of water and carbon dioxide in an adsorption unit 16 (preferably a molecular sieve adsorption unit), and combined with a recycle air stream in line 74 to form a combined air stream in line 18. The combined air stream in line 18 is further compressed in recycle compressor 20, after cooled in heat exchanger 22, and split into two streams in lines 26 and 28 which are respectively compressed again in companders 30 and 32. The streams from lines 34 and 36, which are respectively associated with companders 30 and 32, are combined to form a combined stream in line 38, which is subsequently after cooled in heat exchanger 40 against an external cooling fluid. The resulting stream in line 42 is split into two streams in lines 44 and 46.

Stream in line 46 is expanded in an expansion turbine 48 to a lower pressure and temperature in line 50, which is then combined with the returning recycle air stream in line 70 to form a combined stream in line 72. Stream in line 72 is passed through a warm stage 52 of a main heat exchanger 51 to result in recycle air stream in line 74. Stream in line 44 is cooled in the warm stage 52 of the main heat exchanger 51 before being split into a first stream in line 58 and a second stream in line 60.

First stream in line 58 is cooled in a cold stage 68 of the main heat exchanger 51 leading to a cooled stream in line 76, reduced in pressure across an isenthalpic Joule-Thompson (JT) valve 77, and then flashed in a separator 90 providing feed liquefied air in line 134 for the distillation system and a vapor flash stream in line 132. Second stream in line 60 is expanded in an expansion turbine 62 to a lower temperature and pressure resulting in stream line 64 and then split into two streams in lines 66 and 78.

Stream in line 66 is returned through the cold stage 68 of the main heat exchanger 51 leading to cooled stream in line 70 which is combined with stream in line 50 to form combined stream in line 72. The combined stream in line 72 is then led through the warm stage 52 of the main heat exchanger 51 to form the recycle stream in line 74, as discussed above. Stream in line 78 is combined with vapor flash stream 132 and the resulting steam in line 80 is introduced as a cooled gaseous feed air to the higher pressure stage 82 of the distillation column 81.

Higher pressure stage 82 of the distillation column 81 rectifies the cooled gaseous feed air into a high pressure nitrogen overhead vapor at the top of the higher pressure stage 82 and a crude oxygen liquid at the bottom of the higher pressure stage 82. The high pressure nitrogen overhead vapor is condensed in a reboiler/condenser 84 by heat exchange with an oxygen-enriched liquid from the bottom of a lower pressure stage 86 of distillation column 81. Reboiler/condenser 84 may be contained within and located at the bottom of lower pressure stage 86 as shown or may be located outside of lower pressure stage 86 or elsewhere. A portion of the condensed nitrogen provides reflux to higher pressure stage 82. The remaining portion of the condensed nitrogen is withdrawn via line 110. Although the stream in line 110 may be withdrawn as nitrogen product directly, FIG. 1 shows an embodiment in which stream in line 110 is further processed prior to removal as product as discussed in detail below.

Figure 1A:
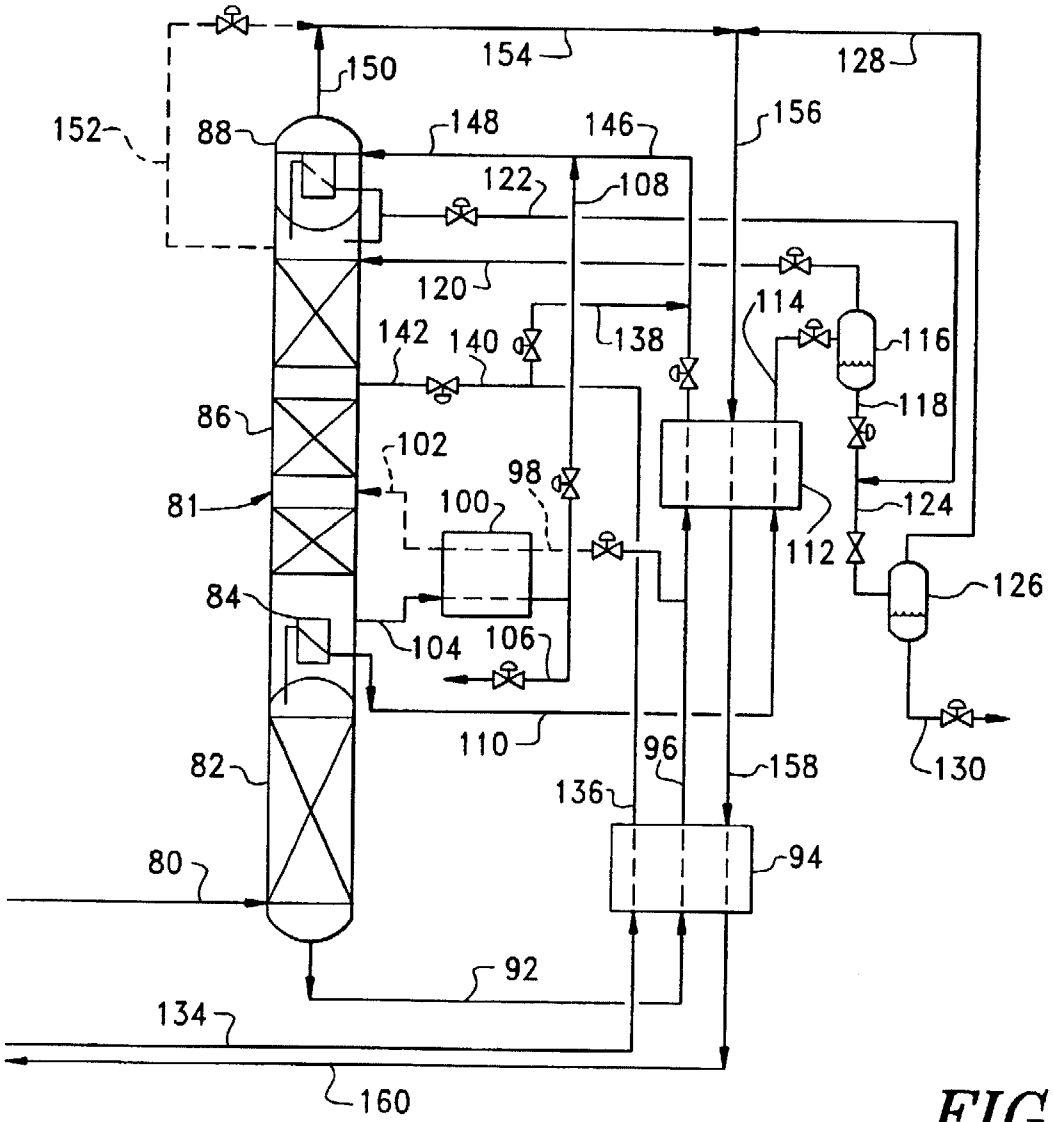
FIG. 1A is fragmentary view of the embodiment shown in FIG. 1 showing, as solid lines, the fluid flow lines in operation during the first mode of operation in which liquid nitrogen is produced and showing the remaining fluid flow lines as dashed lines.

In the first mode of operation during which only liquid nitrogen is produced as a product (as best shown in FIG. 1A), the operating pressure in lower pressure stage 86 is about 0.32 MPa. Liquefied feed air in line 134 is cooled, for example in a sub-cooler 94, against a combined vapor waste stream in line 158. All of the liquefied feed air may then be introduced to the lower pressure stage 86 or, as shown, stream in line 136 may be split into two portions, stream in line 140 and stream in line 138. Stream in line 140 is expanded across a JT valve and introduced into lower pressure stage 86, where the liquefied air is separated into the lower pressure stage gaseous nitrogen at the top of lower pressure stage 86 and the oxygen-enriched liquid at the bottom of lower pressure stage 86 leading to stream in line 104. A portion of liquefied air in line 134 can also be introduced to the higher pressure stage 82 (not shown).

Crude oxygen liquid from higher pressure stage 82 is fed to line 92, sub-cooled in heat exchanger 94 resulting in stream in line 96, sub-cooled further in heat exchanger 112 (again preferably against a combined vapor waste stream in line 156), reduced in pressure across a JT valve, combined with the portion of liquefied air stream in line 138 resulting in stream in line 146, and combined with the oxygen-enriched bottom product from the lower pressure stage 86 in line 108. The resulting stream in line 148 is introduced to a condenser 88 of lower pressure stage 86, where it is vaporized and used to condense the lower pressure stage gaseous nitrogen to form a lower pressure stage nitrogen condensate. Alternatively, either a portion or all of sub-cooled crude oxygen liquid in line 96 could be fed to lower pressure stage 86 via line 102 and later withdrawn as oxygen-enriched liquid in line 104 and directed to condenser 88.

In the first mode of operation, liquid nitrogen product may be withdrawn directly as shown from streams in lines 122 and 110. The process shown in FIG. 1A is an alternative method to direct withdrawal. As shown in FIG. 1A, the remaining portion of the condensed nitrogen (which is not used as reflux) in line 110 is sub-cooled in heat exchanger 112 to result in stream in line 114 and reduced in pressure across a JT valve then flashed in a phase separator 116 to form first low pressure vapor nitrogen in line 120 and low pressure liquid nitrogen in line 118. Low pressure vapor nitrogen is introduced via line 120 to the lower pressure stage 86 near the top of lower pressure stage 86. Low pressure liquid nitrogen stream in line 118 is reduced in pressure then further reduced in pressure across a JT valve and separated in phase separator 126 to form second low pressure vapor nitrogen in line 128 and the liquid nitrogen product in line 130, which may be directed to a liquid nitrogen storage tank (not shown).

As shown in FIG. 1A, the remaining portion of the lower pressure stage nitrogen condensate (which is not used as reflux) in line 122 is combined with low pressure liquid nitrogen after it is initially pressure reduced. Also, the second low pressure vapor nitrogen in line 128 is combined with the oxygen-enriched vapor waste stream in line 154 from condenser 88 to form combined vapor waste stream 156 which is used as a refrigerant to cool the crude oxygen liquid, the liquefied air, and the remaining portion of the condensed nitrogen (which is not used as reflux) from higher pressure stage 82. More specifically, stream in line 156 is first introduced to heat exchanger 112 to sub-cool the remaining portion of the condensed nitrogen in line 110 and crude oxygen liquid in line 96 resulting in stream in line 158. Stream in line 158 is then used to cool crude oxygen liquid in line 92 and liquefied air in line 134 resulting in stream in line 160. Stream in line 160 is used as a refrigerant for the main heat exchanger 51. Specifically, stream in line 160 is fed to the cold stage 68 of the main heat exchanger 51 resulting in stream in line 162, which is fed to the warm stage 52 of the main heat exchanger 51 resulting in waste stream in line 164, which is vented to atmosphere.

Figure 1B:
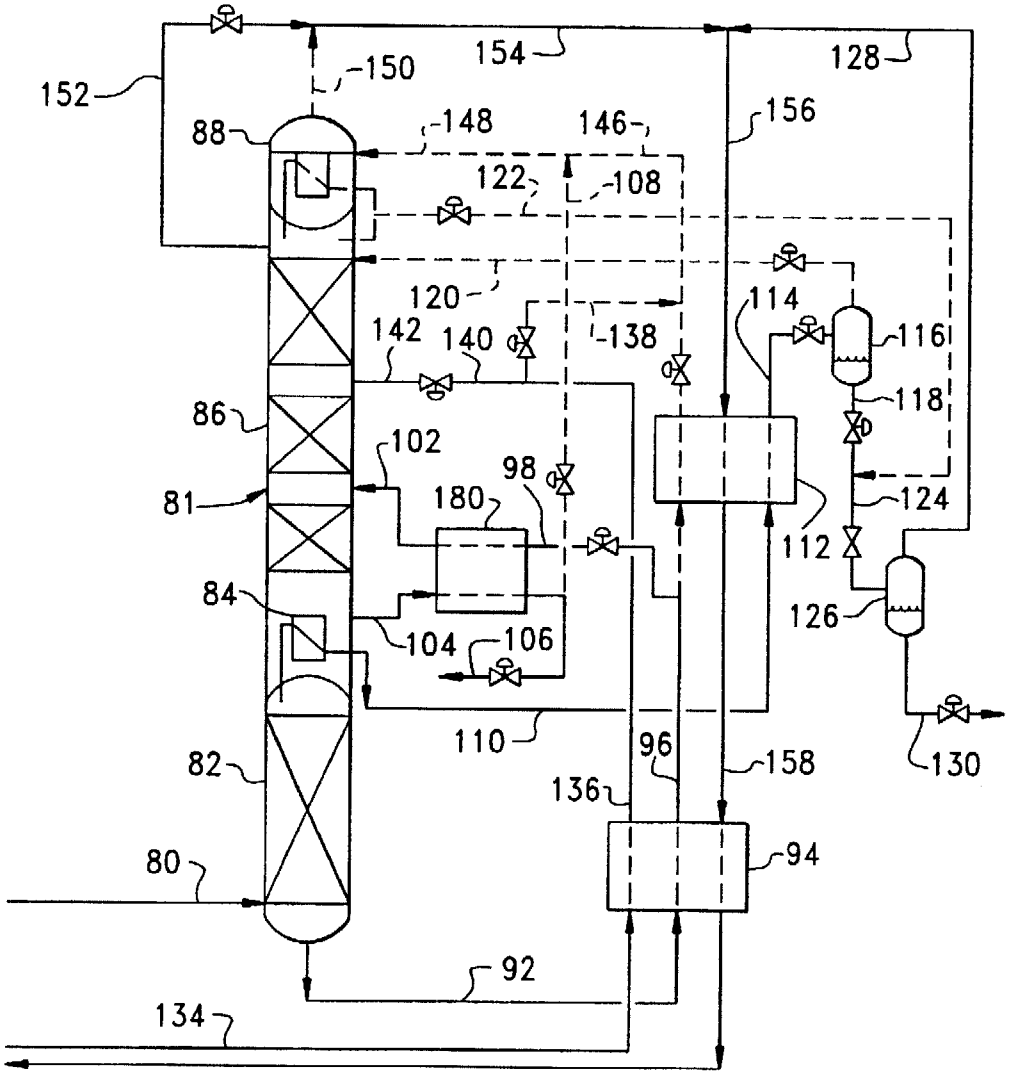
FIG. 1B is a fragmentary view of the embodiment shown in FIG. 1 showing, as solid lines, the fluid flow lines in operation during the second mode of operation in which both liquid nitrogen and liquid oxygen are produced and showing the remaining lines as dashed lines.

In the second mode of operation during which liquid nitrogen and liquid oxygen are produced as products (as best shown in FIG. 1B), the operating pressure in lower pressure stage 86 is about 0.13 MPa. Crude oxygen bottom liquid in line 92 is sub-cooled in heat exchanger 94 and reduced in pressure across a JT valve. The resulting stream in line 98 is passed through liquid oxygen sub-cooler 100 providing necessary refrigeration for liquid oxygen product 106 and introduced in the appropriate location as a feed in line 102 to the lower pressure stage 86 of the distillation column 81. The liquefied feed air in line 134 is sub-cooled, for example in a heat exchanger 94, against a combined vapor waste stream in line 158. The resulting stream in line 136 is then reduced in pressure across a JT valve and fed to the lower pressure stage 86 at a location that is different from the crude oxygen liquid feed location.

In the second mode of operation, all of the liquefied air is directed to stream in line 142 and introduced into lower pressure stage 86. A portion of the liquefied air may be introduced into higher pressure stage 82 (not shown). The various feeds to lower pressure stage 86 are distilled to produce a low pressure vapor overhead waste stream in line 152, which is warmed up in heat exchangers 112, 94, 68, 52 and vented, and oxygen-enriched liquid in line 104, which is sub-cooled in heat exchanger 100 against the crude oxygen liquid in line 98 and withdrawn as product in line 106. Thus, as shown in FIG. 1B, the low pressure overhead waste stream in line 152 is used to cool the remaining portion of the condensed nitrogen from higher pressure stage 82 in line 110, the liquefied air in line 134, and the crude oxygen liquid in line 92. In the second mode of operation, the top condenser 88 is not used.

If necessary, argon can also be produced in the second mode of operation. This would involve an additional side-rectifier connected by liquid and vapor streams to the lower pressure stage 86. This option is not shown in the figures, but it is well-known in the art.

As discussed above, when an overall production LIN/LOX ratio is desired, the times of operation in the first mode and the second mode are selected so that the time-averaged, desired overall production LIN/LOX ratio is achieved. The weight ratio achieved during the second mode of operation is also a factor in determining the relative times of operation in the two modes. In one embodiment, the LIN/LOX ratio in the second mode of operation is 1:1, although this ratio will depend on the liquid/vapor flow rates in each stage, the numbers of theoretical trays in each stage, and the feed composition. In this embodiment, any overall production LIN/LOX ratio greater than or equal to 1:1 can be achieved; for example the overall production LIN/LOX ratio can be infinity by operating exclusively in the first mode of operation or can be 1:1 by operating exclusively in the second mode of operation.

The system of the present invention for producing liquid nitrogen and liquid oxygen includes liquefier 11, which provides a stream of cooled gaseous feed air in line 80 and a stream of liquefied air in line 134, and distillation column 81 which has higher pressure stage 82 and lower pressure stage 86. The system also includes a first set of fluid flow lines 92, 98, 102, 146, 148 and valves, disposed in these lines, extending between the bottom of higher pressure stage 82, condenser 88, and lower pressure stage 86, for permitting crude oxygen liquid to flow from the bottom of higher pressure stage 82 to: (i) condenser 88 during the first mode of operation; and (ii) lower pressure stage 86 during the second mode of operation. For example, during the first mode of operation, the valve disposed between lines 96 and 98 is closed and the valve disposed between lines 96 and 146 is open. In the second mode of operation, the positions of these two valves are reversed. Alternatively, crude oxygen liquid, or a portion thereof, can be directed to lower pressure stage 86 also during the first mode of operation. It is later withdrawn as oxygen-enriched liquid in line 104 and directed to condenser 88 via line 108.

The system also includes a second set of fluid flow lines 104, 106, 108, 148 and valves, disposed in these lines, extending between the bottom of lower pressure stage 86, a liquid oxygen product storage 106 (such as a tank), and condenser 88, for permitting oxygen-enriched liquid to flow from the bottom of lower pressure stage 86 to: (i) condenser 88 during the first mode of operation; and (ii) liquid oxygen product storage via line 106 during the second mode of operation. For example, during the first mode of operation, the valve disposed between lines 104 and 106 is closed and the valve disposed between lines 104 and 108 is open. In the second mode of operation, the positions of these two valves are reversed. It should be noted that some of these lines may overlap one another; for example line 148 can be used as part of both the first and second sets of fluid flow lines and valves.

Figure 2:
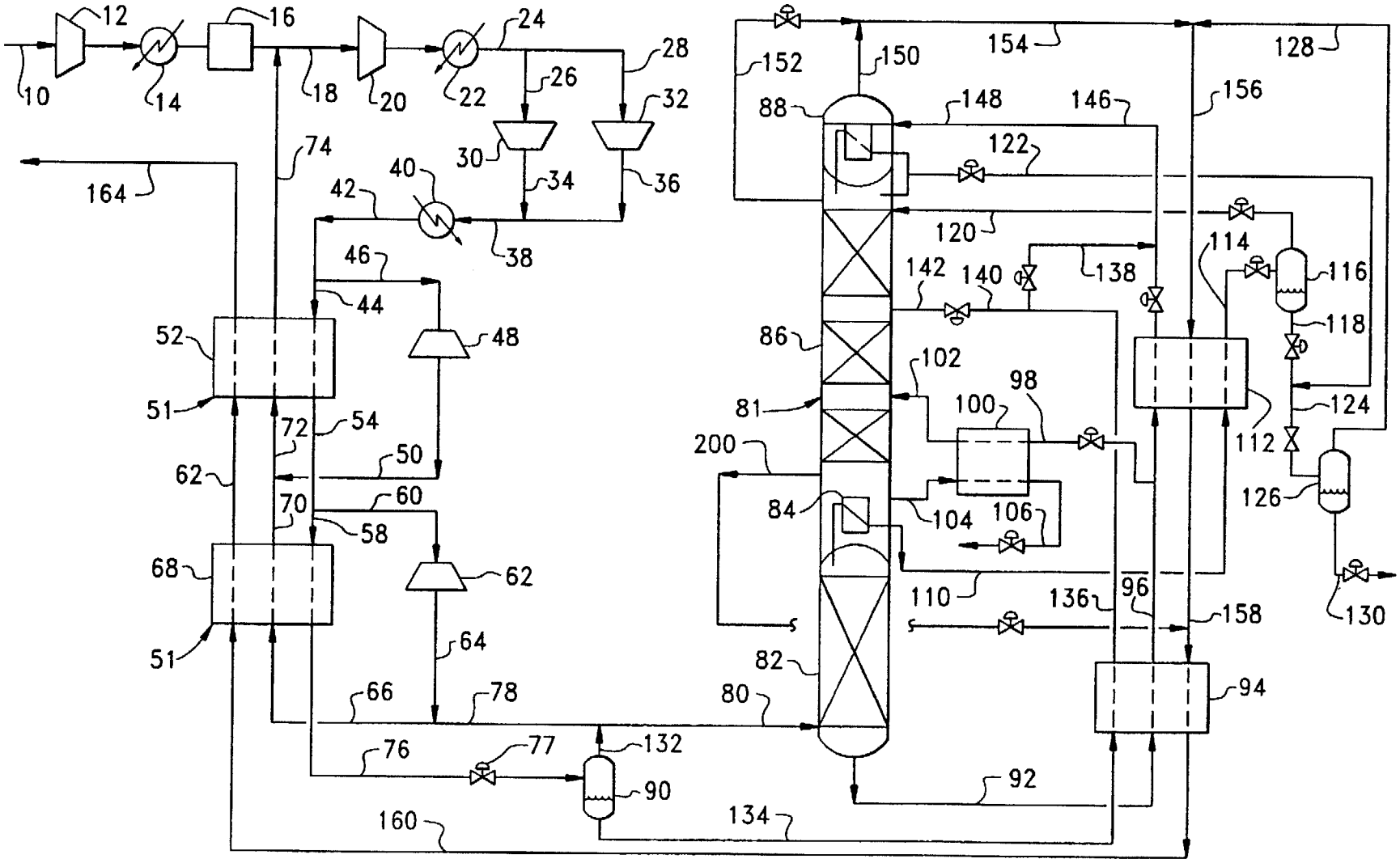
FIG. 2 is a schematic diagram of a second embodiment of the present invention.
Figure 3:
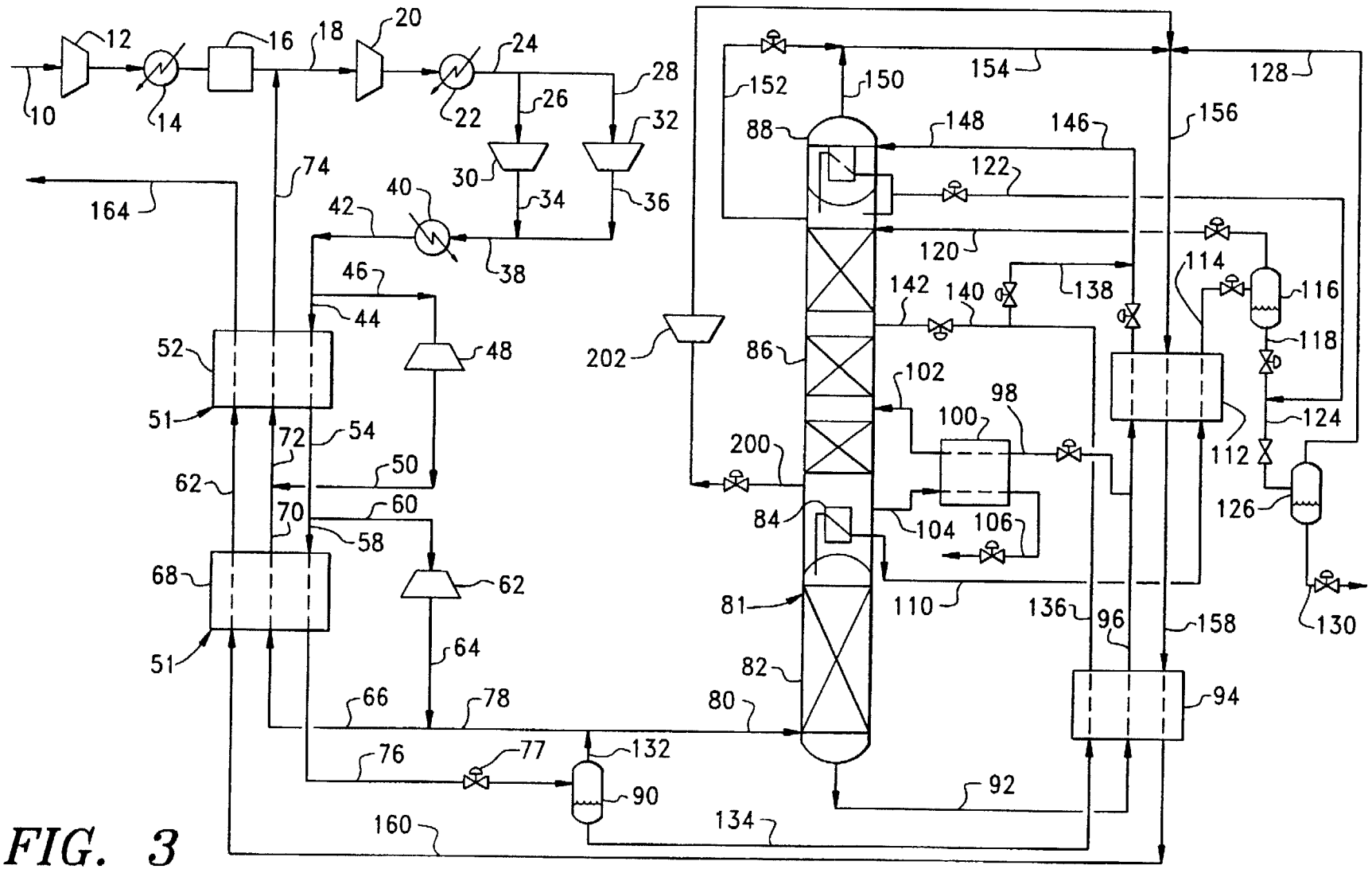
FIG. 3 is a schematic diagram of a third embodiment of the present invention.
Figure 4:
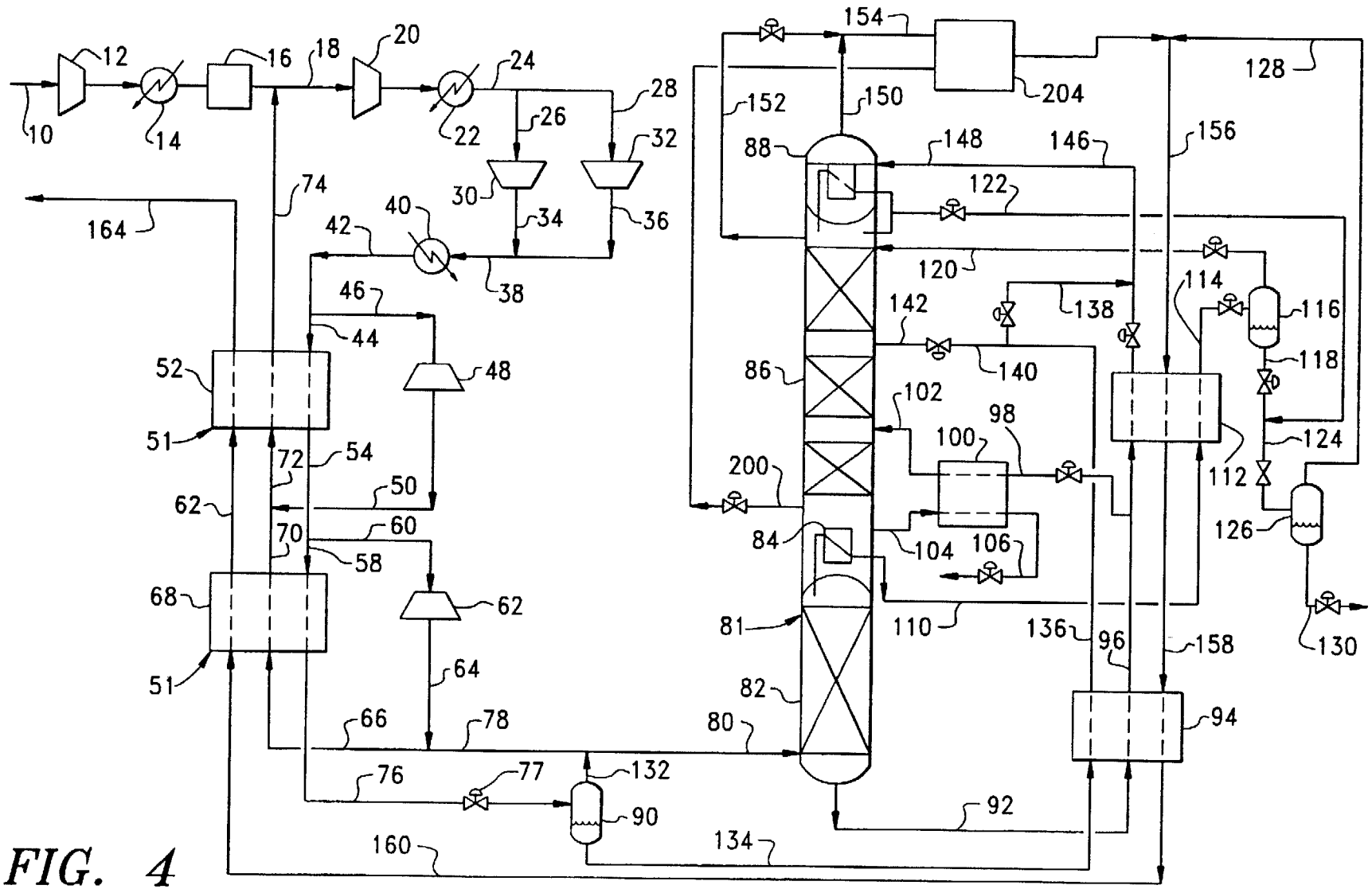
FIG. 4 is a schematic diagram of a fourth embodiment of the present invention.

As an alternative to the second set of fluid flow lines and valves, the system may include a third set of fluid flow lines 200, 104, 106 and valves (as shown in FIGS. 2–4). This third set extends between the bottom of lower pressure stage 86, a liquid oxygen product storage, and a vapor waste stream in line 158 (as in FIG. 2) or 156 (as in FIGS. 3 and 4), for permitting: (i) a bottom vapor waste stream to flow from a first position near the bottom of lower pressure stage 86 to the appropriate vapor waste stream during the first mode of operation; and (ii) the oxygen-enriched liquid to flow from a second position, below said first position, near the bottom of said lower pressure stage to liquid oxygen product storage during the second mode of operation. The first and second positions are selected such that primarily vapor is withdrawn at the first position and primarily liquid is withdrawn at the second position. During the first mode of operation, the valve disposed between lines 104 and 106 is closed and the valve disposed between lines 200 and 158 (as in FIG. 2) or 156 (as in FIGS. 3 and 4) is open. In the second mode of operation, the positions of these two valves are reversed.

The processes using the systems depicted in FIGS. 2–4 are directed to variations in the first mode of operation. As shown in FIG. 2, a bottom vapor waste stream is withdrawn in line 200 instead of removing the liquid waste stream in line 104 from the lower pressure stage 86 and delivering it to condenser 88, as is done in the embodiment shown in FIGS. 1 and 1A. During the first mode of operation in the embodiments shown in FIGS. 2–4, the step of introducing a mixture to condenser 88 includes introducing a portion of the crude oxygen liquid and a portion of the liquefied air to condenser 88. In these embodiments, the remaining portions of the crude oxygen liquid and the liquefied air are introduced to lower pressure stage 88, and a vapor waste stream is withdrawn in line 200 from the bottom of lower pressure stage 86.

In the embodiment shown in FIG. 2, vapor waste stream in line 200 is reduced in pressure across a JT valve and combined with the oxygen-enriched vapor waste stream in line 158 from condenser 88. The resulting stream forms a combined vapor waste stream which is used as a refrigerant to cool the crude oxygen liquid and the liquefied air in heat exchanger 94. This embodiment permits the pressure of lower pressure stage 86 to be reduced from about 0.32 MPa to about 0.24 MPa, although the recovery of liquid nitrogen from the lower pressure stage slightly decreases.

FIG. 3 shows another embodiment of the present invention directed primarily to the first mode of operation. As in the embodiment shown in FIG. 2, vapor waste stream in line 200 is withdrawn from the lower pressure stage 86. Vapor waste stream in line 200 is then expanded in an expander 202 to a lower pressure and combined with the oxygen-enriched vapor waste stream in line 154 from condenser 88. The resulting stream in line 156 forms a combined vapor waste stream which is used as a refrigerant to cool the crude oxygen liquid, the liquefied air, and the remaining portion of the condensed nitrogen from higher pressure stage 82, in heat exchangers 112 and 94. In this embodiment, the pressure in lower pressure stage 86 remains at about 0.24 MPa, but recovery of nitrogen increases compared to the embodiment shown in FIG. 2.

FIG. 4 shows yet another embodiment of the present invention directed primarily to the first mode of operation. As in the embodiments shown in FIGS. 2 and 3, vapor waste stream in line 200 is withdrawn from the lower pressure stage 86. Vapor waste stream in line 200 is then directed to an eductor 204, where it is reduced in pressure and combined with the oxygen-enriched vapor waste stream from condenser 88. Eductor 204 also serves to reduce the pressure of the oxygen-enriched vapor waste stream in line 154 and, consequently, of condenser 88 via line 150. The resulting stream in line 156 forms a combined vapor waste stream which is used as a refrigerant to cool the crude oxygen liquid, the liquefied air, and the remaining portion of the condensed nitrogen from higher pressure stage 82, in heat exchangers 112 and 94.

Figure 5:
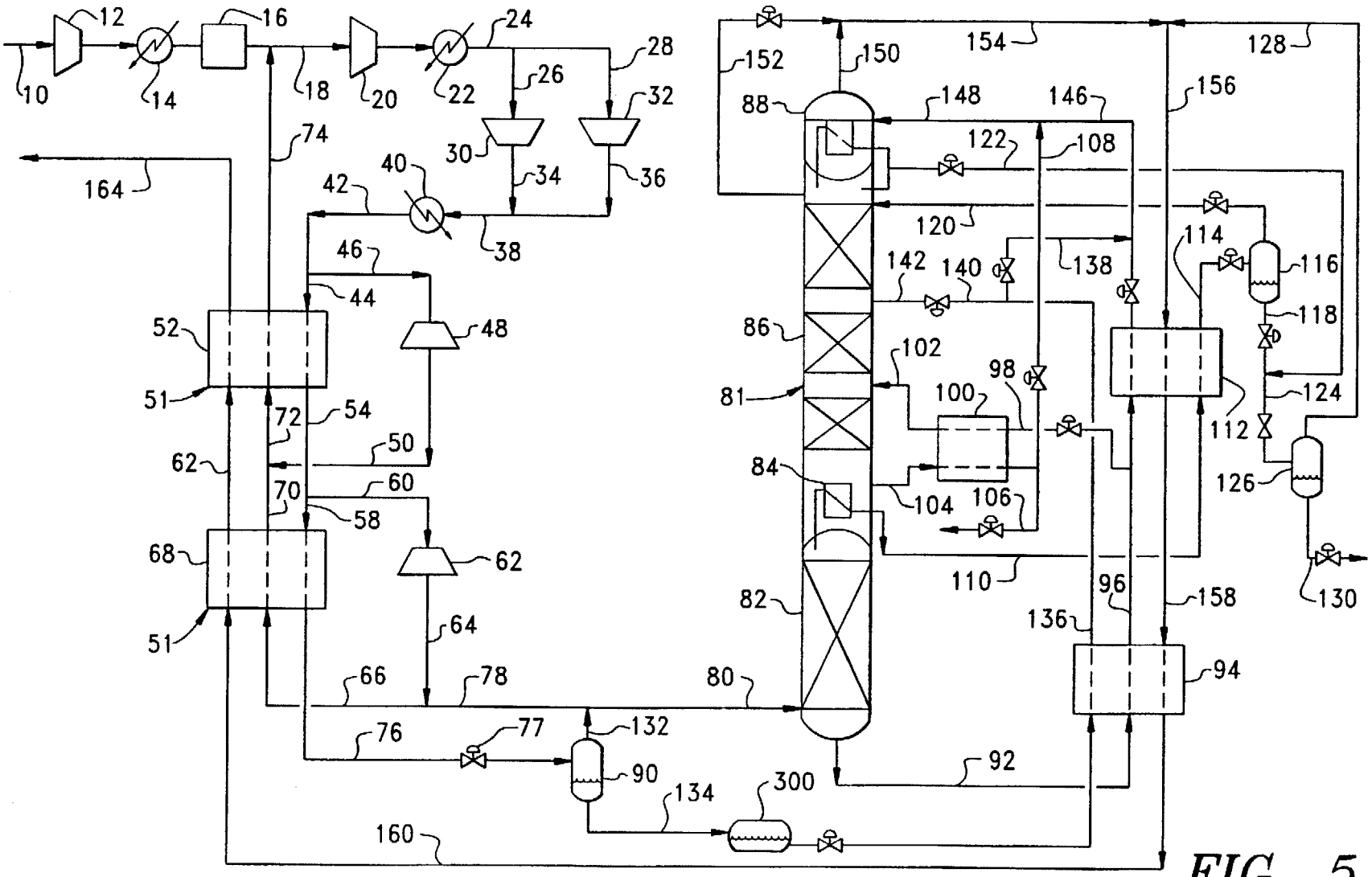
FIG. 5 is a schematic diagram of a fifth embodiment of the present invention.

FIG. 5 shows another alternative embodiment of the present invention for use when power cost varies depending on the time of the day. In this case, the liquefaction system has been intentionally oversized to produce an excess mount of liquefied air during hours when the cost of power is relatively low. Excess liquefied air is stored in storage tank 300, which is disposed between liquefier 11 and distillation column 81. Excess liquefied air is stored during a first time period when the cost of power is relatively lower. At least a portion of the excess air is used during a second period of time when the cost of power is relatively higher, at which time liquefaction system may be turned off; during the time when the liquefaction system is off, the required gaseous air is supplied from the main air compressor.

EXAMPLES

In order to demonstrate the efficacy of the present invention and to provide a comparison to a conventional process, the following examples were developed. In Table 1 below, the power required for the proposed cycle has been calculated for a 600 ton/day liquefier, assuming isothermal efficiency for main compressor 12 and recycle compressor 20 of 70%, isentropic efficiency for compander compressor 30, 32 of 83%, and isentropic efficiency for expanders 48, 62 of 89%. For comparison, the power required by a conventional full recovery nitrogen recycle, producing 600 tons/day of liquids at a fixed LIN/LOX ratio of 2.5, has also been determined. The power required by the conventional full recovery nitrogen recycle was about 2% higher than the power required by the present invention at the same LIN/LOX ratio, namely 11,818 kW versus 11,572 kW.

TABLE 1

Power of Compared Liquefiers at a Production Rate 600 t/day

| CYCLE | LIN/LOX weight ratio | Power [kW] |
|---|---|---|
| Present Invention, second mode | 1.2 | 11,643 |
| Present Invention, first mode | ∞ | 11,454 |
| Full recovery, nitrogen recycle | 2.5 | 11,818 |

Some of the stream parameters of simulations are shown in Tables 2 and 3. The basis of the simulations is the production of 600 ton/day of liquid product, namely 600 ton/day of liquid nitrogen in the case of Table 2 and 600 ton/day of total liquid including liquid nitrogen and liquid oxygen in the case of Table 3. The feed used in the simulations was atmospheric air at the pressure and temperature shown in Tables 2 and 3 for stream in line 10. In the simulations, the number of theoretical trays in the higher pressure stage was 40 and the number of theoretical trays in the lower pressure stage was 73.

In the simulation reported in Table 2, the product liquid nitrogen contained 2 ppm of oxygen, and the waste stream in line 164 had a composition of 61.64% nitrogen and 36.73% oxygen, along with some argon.

In the simulation reported in Table 3, the product liquid nitrogen contained 2 ppm of oxygen, and the purity of liquid oxygen produced was 99.50%. The waste stream in line 164 had a composition of 89.82% nitrogen and 8.85% oxygen, along with some argon.

TABLE 2

Stream Parameters for the Embodiment shown in FIG. 1 during the First Mode of Operation (also shown in FIG. 1A)

| Stream in Line Number | Temperature (°F.) | Temperature (K.) | Pressure (psi) | Pressure (kPa) | Flow Rate (lbmol/hour) | Flow Rate gmole/s |
|---|---|---|---|---|---|---|
| 10 | 80.0 | 299.8 | 14.7 | 101.4 | 4188.8 | 527.8 |
| 132 | −280.2 | 99.7 | 94.0 | 648.1 | 38.8 | 4.9 |
| 78 | −276.7 | 101.7 | 93.1 | 641.9 | 2139.7 | 269.6 |
| 134 | −280.1 | 99.8 | 94.0 | 648.1 | 1977.6 | 249.2 |
| 140 | −283.0 | 98.2 | 93.0 | 641.2 | 1684.6 | 212.3 |
| 142 | −290.9 | 93.8 | 60.0 | 413.7 | 1684.6 | 212.3 |
| 138 | −283.0 | 98.2 | 93.0 | 641.2 | 293.0 | 36.9 |
| 92 | −277.1 | 101.4 | 93.0 | 641.2 | 1235.1 | 155.6 |
| 96 | −283.0 | 98.2 | 92.0 | 634.3 | 1235.1 | 155.6 |
| 146 | −290.0 | 94.3 | 91.0 | 627.4 | 1528.1 | 192.5 |
| 104 | −287.6 | 95.6 | 50.9 | 350.9 | 657.1 | 82.8 |
| 110 | −285.6 | 96.7 | 89.1 | 614.3 | 943.4 | 118.9 |
| 114 | −290.0 | 94.3 | 88.1 | 607.4 | 943.4 | 118.9 |
| 118 | −299.4 | 89.0 | 48.0 | 330.9 | 879.9 | 110.9 |
| 120 | −299.4 | 89.0 | 48.0 | 330.9 | 63.5 | 8.0 |
| 122 | −299.8 | 88.8 | 47.0 | 324.1 | 1091.1 | 137.5 |
| 128 | −315.5 | 80.1 | 20.0 | 137.9 | 185.2 | 23.3 |
| 130 | −315.5 | 80.1 | 20.0 | 137.9 | 225.0 | |
| | | | | 1785.7 | | |
| 150 | −302.5 | 87.3 | 20.0 | 137.9 | 2185.2 | 275.3 |
| 156 | −303.8 | 86.6 | 19.0 | 131.0 | 2370.5 | 298.7 |
| 158 | −293.9 | 92.1 | 18.0 | 124.1 | 2370.5 | 298.7 |
| 160 | −283.7 | 97.8 | 17.0 | 117.2 | 2370.5 | 298.7 |
| 164 | 82.9 | 301.4 | 15.0 | 103.4 | 2370.5 | 298.7 |

TABLE 3

Stream Parameters for the Embodiment shown in FIG. 1 during the Second Mode of Operation (also shown in FIG. 1B)

| Stream Number | Temperature (°F.) | Temperature (K.) | Pressure (psi) | Pressure (kPa) | Flow Rate (lbmol/hour) | Flow Rate gmole/s |
|---|---|---|---|---|---|---|
| 10 | 80.0 | 299.8 | 14.7 | 101.4 | 4619.0 | 581.98 |
| 132 | −280.2 | 99.7 | 95.0 | 655.0 | 20.4 | 2.57 |
| 78 | −276.7 | 101.7 | 90.2 | 621.9 | 2637.1 | 332.27 |
| 134 | −280.1 | 99.8 | 95.0 | 655.0 | 1929.4 | 243.10 |
| 136 | −290.0 | 94.3 | 94.0 | 648.1 | 1929.4 | 243.10 |
| 142 | −308.4 | 84.0 | 25.0 | 172.4 | 1929.4 | 243.10 |
| 92 | −277.1 | 101.4 | 93.1 | 641.9 | 1513.0 | 190.63 |
| 96 | −290.0 | 94.3 | 92.1 | 635.0 | 1513.0 | 190.63 |
| 98 | −305.6 | 85.6 | 25.0 | 172.4 | 1513.0 | 190.63 |
| 102 | −306.3 | 85.2 | 24.0 | 165.5 | 1513.0 | 190.63 |
| 104 | −287.6 | 95.6 | 25.1 | 173.1 | 714.0 | 89.96 |
| 106 | −292.6 | 92.8 | 24.1 | 166.2 | 714.0 | 89.96 |
| 110 | −285.6 | 96.7 | 89.2 | 615.0 | 1144.5 | 144.20 |
| 114 | −289.7 | 94.4 | 88.2 | 608.1 | 1144.5 | 144.20 |
| 128 | −314.6 | 80.6 | 21.2 | 146.2 | 176.3 | 22.21 |
| 130 | −314.6 | 80.6 | 21.2 | 146.2 | 968.2 | 121.99 |
| 152 | −310.5 | 82.9 | 21.2 | 146.2 | 2728.4 | 343.77 |
| 156 | −310.9 | 82.7 | 20.7 | 142.7 | 2904.7 | 365.98 |
| 158 | −308.1 | 84.2 | 19.7 | 135.8 | 2904.7 | 365.98 |
| 160 | −283.0 | 98.2 | 18.7 | 128.9 | 2904.7 | 365.98 |
| 164 | 80.1 | 299.8 | 15.7 | 108.2 | 2904.7 | 365.98 |

Although illustrated and described herein with reference to certain specific embodiments, the present invention is nevertheless not intended to be limited to the details shown. Rather, various modifications may be made in the details within the scope and range of equivalents of the claims and without departing from the spirit of the invention.

What is claimed:

1. A method of operating a cryogenic distillation column having a higher pressure stage and a lower pressure stage to produce liquid nitrogen comprising the steps of: (a) using a liquefier to provide a stream of cooled gaseous feed air and a stream of liquefied air; (b) introducing said cooled gaseous feed air into said higher pressure stage of said distillation column for rectification into a high pressure nitrogen overhead at the top of said higher pressure stage and a crude oxygen liquid at the bottom of said higher pressure stage; (c) condensing said high pressure nitrogen from said higher pressure stage by heat exchange with an lo oxygen-enriched liquid from the bottom of said lower pressure stage of said distillation column; (d) utilizing a portion of said condensed nitrogen as reflux to said higher pressure stage of said distillation column; (e) introducing at least a portion of said liquefied air to said lower pressure stage to separate said liquefied air in said lower pressure stage into lower pressure stage gaseous nitrogen at the top of said lower pressure stage and said oxygen-enriched liquid at the bottom of said lower pressure stage; characterized in that said method further comprises the steps of: (f) introducing a stream including: (i) at least a portion of said crude oxygen liquid and (ii) at least a portion of at least one of said oxygen-enriched liquid and said liquefied air, to a condenser of said lower pressure stage to condense said lower pressure stage gaseous nitrogen to form a lower pressure stage nitrogen condensate; and utilizing a portion of said lower pressure stage nitrogen condensate as reflux to said lower pressure stage and withdrawing the remaining portion of said lower pressure stage nitrogen condensate and the remaining portion of said condensed nitrogen as liquid nitrogen product.

2. The method of claim 1, wherein the step of introducing a stream to the condenser of said lower pressure stage includes introducing all of said crude oxygen liquid, all of said oxygen-enriched liquid, and a portion of said liquefied air to the condenser of said lower pressure stage.

3. The method of claim 1, wherein:

the step of introducing a stream to the condenser of said lower pressure stage comprises introducing a portion of said crude oxygen liquid and a portion of said liquefied air to said condenser of said lower pressure stage; and said method further comprises the step of introducing the remaining portion of said crude oxygen liquid to said lower pressure stage.

4. The method of claim 3 further comprising the step of withdrawing a vapor waste stream from the bottom of said lower pressure stage.

5. The method of claim 4 further comprising the step of isenthalpically reducing the pressure of the vapor waste stream from the bottom of said lower pressure stage and combining said vapor waste stream with an oxygen-enriched vapor waste stream from said condenser of said lower pressure stage to form a combined vapor waste stream which is used as a refrigerant to sub-cool said crude oxygen liquid and said liquefied air.

6. The method of claim 4 further comprising step of isentropically reducing the pressure of the vapor waste stream from the bottom of said lower pressure stage by using an expander and combining said vapor waste stream with an oxygen-enriched vapor waste stream from said condenser of said lower pressure stage to form a combined vapor waste stream which is used as a refrigerant to cool said crude oxygen liquid, said liquefied air, and the remaining portion of said condensed nitrogen from said higher pressure stage.

7. The method of claim 4 further comprising the step of pressure reducing said vapor waste stream and combining said vapor waste stream with an oxygen-enriched vapor waste stream from said condenser of said lower pressure stage in an eductor to form a combined vapor waste stream which is used as a refrigerant to cool said crude oxygen liquid, said liquefied air, and the remaining portion of said condensed nitrogen from said higher pressure stage.

8. The method of claim 1, wherein the step of withdrawing the remaining portion of said condensed nitrogen from said higher pressure stage as liquid nitrogen product includes the steps of:

cooling said remaining portion of said condensed nitrogen against an oxygen-enriched vapor waste stream from said condenser of said lower pressure stage;

phase separating said cooled condensed nitrogen in a first separator to form first low pressure vapor nitrogen and low pressure liquid nitrogen; and phase separating said low pressure liquid nitrogen in a second separator to form second low pressure vapor nitrogen and said liquid nitrogen product.

9. The method of claim 8 further comprising the steps of:

introducing said first low pressure vapor nitrogen to the top of said lower pressure stage;

combining the remaining portion of said lower pressure stage nitrogen condensate with said low pressure liquid nitrogen; and combining said second low pressure vapor nitrogen with an oxygen-enriched vapor waste stream from said condenser of said lower pressure stage to form a combined vapor waste stream which is used as a refrigerant to cool said crude oxygen liquid, said liquefied air, and the remaining portion of said condensed nitrogen from said higher pressure stage.

10. A method of operating a cryogenic distillation column having a higher pressure stage and a lower pressure stage, wherein said column is capable of operation in a first mode of operation wherein only liquid nitrogen is produced and a second mode of operation wherein liquid nitrogen and liquid oxygen are produced, to produce liquid nitrogen and liquid oxygen at a first weight ratio comprising the steps of:

using a liquefier to provide a stream of cooled gaseous feed air and a stream of liquefied air;

introducing said cooled gaseous feed air into said higher pressure stage of said distillation column for rectification into high pressure nitrogen at the top of said higher pressure stage and a crude oxygen liquid at the bottom of said higher pressure stage;

condensing said high pressure nitrogen from said higher pressure stage by heat exchange with an oxygen-enriched liquid from the bottom of said lower pressure stage of said distillation column;

utilizing a portion of said condensed nitrogen as reflux to said higher pressure stage;

withdrawing the remaining portion of said condensed nitrogen as liquid nitrogen product; and operating said column by using the first mode of operation for a first period of time and then operating said column using the second mode of operation for a second period of time, wherein said first period of time and a said second period of time are sufficient such that when averaged over the combined first and second time periods liquid nitrogen and liquid oxygen are produced at said first weight ratio wherein:

(a) the first mode of operation during which only liquid nitrogen is withdrawn as a product is operated by:

(i) introducing at least a portion of at least one of said liquefied air and said crude oxygen liquid to said lower pressure stage to form lower pressure stage gaseous nitrogen at the top of said lower pressure stage and said oxygen-enriched liquid at the bottom of said lower pressure stage;

(ii) introducing a stream selected from the group consisting of: at least a portion of said crude oxygen liquid, at least a portion of said oxygen-enriched liquid, at least a portion of said liquefied air, and mixtures thereof, to a condenser of said lower pressure stage to condense said lower pressure stage gaseous nitrogen to form a lower pressure stage nitrogen condensate; and (iii) utilizing a portion of said lower pressure stage nitrogen condensate as reflux to said lower pressure stage and withdrawing the remaining portion of said lower pressure stage nitrogen condensate as liquid nitrogen product; and (b) the second mode of operation during which liquid nitrogen and liquid oxygen are withdrawn as products at a second weight ratio of liquid nitrogen to liquid oxygen which is less than or equal to said first weight ratio is operated by:

(i) pressure reducing said crude oxygen liquid and introducing said crude oxygen liquid into said lower pressure stage;

(ii) cooling and pressure reducing said stream of liquefied air and introducing said liquefied air into said lower pressure stage at a location different from the location at which said crude oxygen liquid is introduced into said lower pressure stage; and (iii) operating said lower pressure stage to produce a low pressure overhead waste stream containing nitrogen and said oxygen-enriched liquid which is a product liquid oxygen stream.

11. The method of claim 10, wherein said second weight ratio is approximately 1:1.

12. The method of claim 10, wherein (b) further comprises the step of cooling said liquefied air, the remaining portion of said condensed nitrogen from said higher pressure stage, and said crude oxygen liquid against said low pressure overhead waste stream containing nitrogen.

13. The method of claim 10 further comprising the steps of:

storing an excess amount of liquefied air during a first time period; and utilizing at least a portion of said excess amount of liquefied air during a second time period.

14. The method of claim 10, wherein:

the step of (a)(i) comprises introducing a portion of said liquefied air to said lower pressure stage; and the step of (a)(ii) comprises introducing the remaining portion of said liquefied air, all of said crude oxygen liquid, and all of said oxygen-enriched liquid to said condenser of said lower pressure stage.

15. The method of claim 10, wherein the step of (a)(ii) comprises introducing a portion of said liquefied air to said condenser of said lower pressure stage.

16. The method of claim 10, wherein the step of (a)(ii) comprises introducing a portion of said crude oxygen liquid to said condenser of said lower pressure stage.

17. The method of claim 10, wherein (b) further comprises the step of cooling said crude oxygen liquid against said product liquid oxygen.

18. A cryogenic distillation process for producing liquid nitrogen including the steps of: (a) liquefying a feed to provide a stream of cooled gaseous feed air and a stream of liquefied air; (b) rectifying said cooled gaseous feed air in a higher pressure stage of a distillation column into a high pressure nitrogen overhead and a crude oxygen liquid; (c) separating at least a portion of said liquefied air in a lower pressure stage of said distillation column into lower pressure stage gaseous nitrogen and an oxygen-enriched liquid; (d) condensing said high pressure nitrogen in a reboiler/condenser by heat exchange with said oxygen-enriched liquid to form condensed nitrogen; (e) condensing said lower pressure stage gaseous nitrogen in a condenser; characterized in that said process further comprises the steps of: (f) introducing a stream selected from the group consisting of: (i) at least a portion of said crude oxygen liquid, (ii) at least a portion of said oxygen-enriched liquid, (iii) at least a portion of said liquefied air, and (iv) mixtures thereof, to said condenser to condense said lower pressure stage gaseous nitrogen to form a lower pressure stage nitrogen condensate and (g) withdrawing said condensed nitrogen from said higher pressure stage and said lower pressure stage nitrogen condensate as liquid nitrogen products.

19. A system for producing liquid nitrogen and liquid oxygen having a liquefier to provide a stream of cooled gaseous feed air and a stream of liquefied air and having a distillation column including: (i) a higher pressure stage for rectifying said cooled gaseous feed air into a high pressure nitrogen overhead and a crude oxygen liquid; (ii) a lower pressure stage for separating at least a portion of said cooled liquefied air into lower pressure stage gaseous nitrogen and an oxygen-enriched liquid; (iii) a reboiler/condenser for condensing said high pressure nitrogen by heat exchange with said oxygen-enriched liquid to form condensed nitrogen; and (iv) a condenser for selectively condensing said lower pressure stage gaseous nitrogen, characterized in that:

(a) a first set of fluid flow lines and valves extend between the bottom of said higher pressure stage, said condenser, and said lower pressure stage, for permitting crude oxygen liquid to flow from the bottom of said higher pressure stage to:

(i) said condenser during a first mode of operation during which only nitrogen is produced; and (ii) said lower pressure stage during a second mode of operation during which liquid oxygen and liquid nitrogen are produced; and (b) a second set of fluid flow lines and valves extend between the bottom of said lower pressure stage, a liquid oxygen product storage, and said condenser, for permitting said oxygen-enriched liquid to flow from the bottom of said lower pressure stage to:

(i) said condenser during said first mode of operation; and (ii) said liquid oxygen product storage during said second mode of operation.

20. The system of claim 19 further comprising a storage tank disposed between said liquefier and said distillation column for storing an excess amount of said liquefied air.

21. A system for producing liquid nitrogen and liquid oxygen having a liquefier to provide a stream of cooled gaseous feed air and a stream of liquefied air and having a distillation column including: (i) a higher pressure stage for rectifying said cooled gaseous feed air into a high pressure nitrogen overhead and a crude oxygen liquid; (ii) a lower pressure stage for separating at least a portion of said cooled liquefied air into lower pressure stage gaseous nitrogen and an oxygen-enriched liquid; (iii) a reboiler/condenser for condensing said high pressure nitrogen by heat exchange with said oxygen-enriched liquid to form condensed nitrogen; and (iv) a condenser for selectively condensing said lower pressure stage gaseous nitrogen characterized in that:

(a) a first set of fluid flow lines and valves extend between the bottom of said higher pressure stage, said condenser, and said lower pressure stage, for permitting crude oxygen liquid to flow from the bottom of said higher pressure stage to:

(i) said condenser during a first mode of operation during which only nitrogen is produced; and (ii) said lower pressure stage during a second mode of operation during which liquid oxygen and liquid nitrogen are produced; and (b) a second set of fluid flow lines and valves extend between the bottom of said lower pressure stage, a liquid oxygen product storage, and a vapor waste stream, for permitting:

(i) a bottom vapor waste stream to flow from a first position near the bottom of said lower pressure stage to said vapor waste stream during said first mode of operation; and (ii) said oxygen-enriched liquid to flow from a second position, below said first position, near the bottom of said lower pressure stage to said liquid oxygen product storage during said second mode of operation.

* * * * *

UNITED STATES PATENT AND TRADEMARK OFFICE

CERTIFICATE OF CORRECTION

PATENT NO. : 5,678,425

DATED : Oct. 21, 1997

INVENTOR(S) : Rakesh Agrawal et al.

It is certified that error appears in the above-identified patent and that said Letters Patent is hereby corrected as shown below:

Column 12, Line 9
Delete "lo"

Signed and Sealed this

Sixth Day of January, 1998

*Attest:*

*Attesting Officer*

BRUCE LEHMAN

*Commissioner of Patents and Trademarks*